US009403379B2

(12) United States Patent
Kohnotoh et al.

(10) Patent No.: US 9,403,379 B2
(45) Date of Patent: Aug. 2, 2016

(54) PRINTING CONTROL METHOD AND PRINTING APPARATUS

(75) Inventors: Atsushi Kohnotoh, Machida (JP); Kazuo Ohyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/477,969

(22) Filed: May 22, 2012

(65) Prior Publication Data

US 2012/0299990 A1 Nov. 29, 2012

(30) Foreign Application Priority Data

May 26, 2011 (JP) ..... 2011-118269

(51) Int. Cl.
*B41J 29/38* (2006.01)
*B41J 3/60* (2006.01)

(52) U.S. Cl.
CPC ..... *B41J 3/60* (2013.01)

(58) Field of Classification Search
CPC ..... B41J 3/60; B41J 11/002
USPC ..... 347/14, 16, 102
See application file for complete search history.

(56) References Cited

U.S. PATENT DOCUMENTS

| | | | | |
|---|---|---|---|---|
| 7,204,572 | B2 * | 4/2007 | Seki et al. | 347/16 |
| 7,270,392 | B2 * | 9/2007 | Mizuno | 347/19 |
| 7,360,857 | B2 * | 4/2008 | Koshikawa | 347/16 |
| 8,169,658 | B2 * | 5/2012 | Saito | 358/1.8 |
| 2002/0024574 | A1 * | 2/2002 | Uchida | 347/104 |
| 2004/0095406 | A1 * | 5/2004 | Uchida | 347/16 |
| 2004/0263553 | A1 * | 12/2004 | Mizuno | 347/16 |
| 2006/0238594 | A1 * | 10/2006 | Tham et al. | 347/104 |
| 2008/0068632 | A1 * | 3/2008 | Fukasawa | 358/1.12 |
| 2009/0244236 | A1 * | 10/2009 | Houjou | 347/102 |

FOREIGN PATENT DOCUMENTS

| | | | |
|---|---|---|---|
| JP | 2005-280213 | A | 10/2005 |
| JP | 2005-349710 | A | 12/2005 |
| JP | 2008183719 | A * | 8/2008 |
| JP | 4522156 | B2 | 8/2010 |
| JP | 2011-011552 | A | 1/2011 |

* cited by examiner

*Primary Examiner* — Stephen Meier
*Assistant Examiner* — Sharon A Polk
(74) *Attorney, Agent, or Firm* — Canon USA Inc. IP Division

(57) ABSTRACT

For each of a plurality of areas in at least one of a sheet width direction and a sheet conveying direction included in a sheet trailing edge area during printing on a first surface, information regarding an ink application amount to the area is acquired. According to a combination of acquired pieces of information regarding the ink application amounts to the plurality of areas, waiting time until a printing start on a second surface from an end of printing in the sheet trailing edge area is determined.

33 Claims, 7 Drawing Sheets

PRINTING CONTROL METHOD AND PRINTING APPARATUS

BACKGROUND OF THE INVENTION

1. Field of the Invention

The present invention relates to controlling of an ink-jet printing apparatus that can print images on both sides of a sheet.

2. Description of the Related Art

Japanese Patent No. 4,522,156 discusses a printing apparatus that reverses a sheet therein to print images on both sides of the sheet by an ink-jet method. In this apparatus, waiting time until a printing operation start on a second surface (back surface) of the sheet is set based on information regarding an ink application amount to a sheet edge of a first surface (front surface) of the sheet. Jamming or head rubbing may occur when the sheet is conveyed in a cockling state while drying of the ink applied to the first surface is insufficient. The jamming or head rubbing is suppressed with the method discussed in the Japanese Patent No. 4,522,156.

In the printing apparatus discussed in the Japanese Patent No. 4,522,156, the waiting time until the printing start on the second surface is set based on ink applications to at least leading and trailing edges or left and right edges among four side edges of the first surface. Japanese Patent No. 4,522,156 discusses an embodiment of the printing apparatus in which the leading edge and the trailing edge of the sheet are divided into centers (Ea and Eb) and left and right edges (Ea' and Eb'), and a standby period based on an ink application amount is read from a data table for each area. Then, the longest one of the plurality of read standby periods is selected, and the waiting time until second surface recording is set based on the longest standby period.

In such a configuration, for example, when the ink application amount is large only at the center while there is almost no ink applied to the left and right edges, the occurrence of sheet cockling is not practically a problem. Despite that, long waiting time occurs. Similarly, long waiting time occurs conversely when ink application amounts are large only at the left and right edges while there is almost no ink applied to the center. In other words, there is a possibility that waiting time longer than necessary will be set even for a pattern of a low jamming possibility. The increase of waiting time means reduction of total throughput of two-sided print.

SUMMARY OF THE INVENTION

The present invention is directed to achievement of printing throughput higher than conventionally while suppressing jamming or head rubbing during two-sided printing.

According to an aspect of the present invention, there is provided a printing control method configured to control to feed a sheet to a printing unit to print an image on a first surface, reverse the sheet for front and back surfaces and leading and trailing sides to feed to the printing unit, and print an image on a second surface of a back surface of the first surface. The printing control method includes steps of: acquiring, for each of a plurality of different areas in at least one of a sheet width direction and a sheet conveying direction included in a sheet trailing edge area during printing on the first surface, information regarding an ink application amount to the area; and determining, according to a combination of acquired pieces of information regarding the ink application amounts to the plurality of areas, waiting time until a printing start on the second surface from an end of printing in the sheet trailing edge area.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
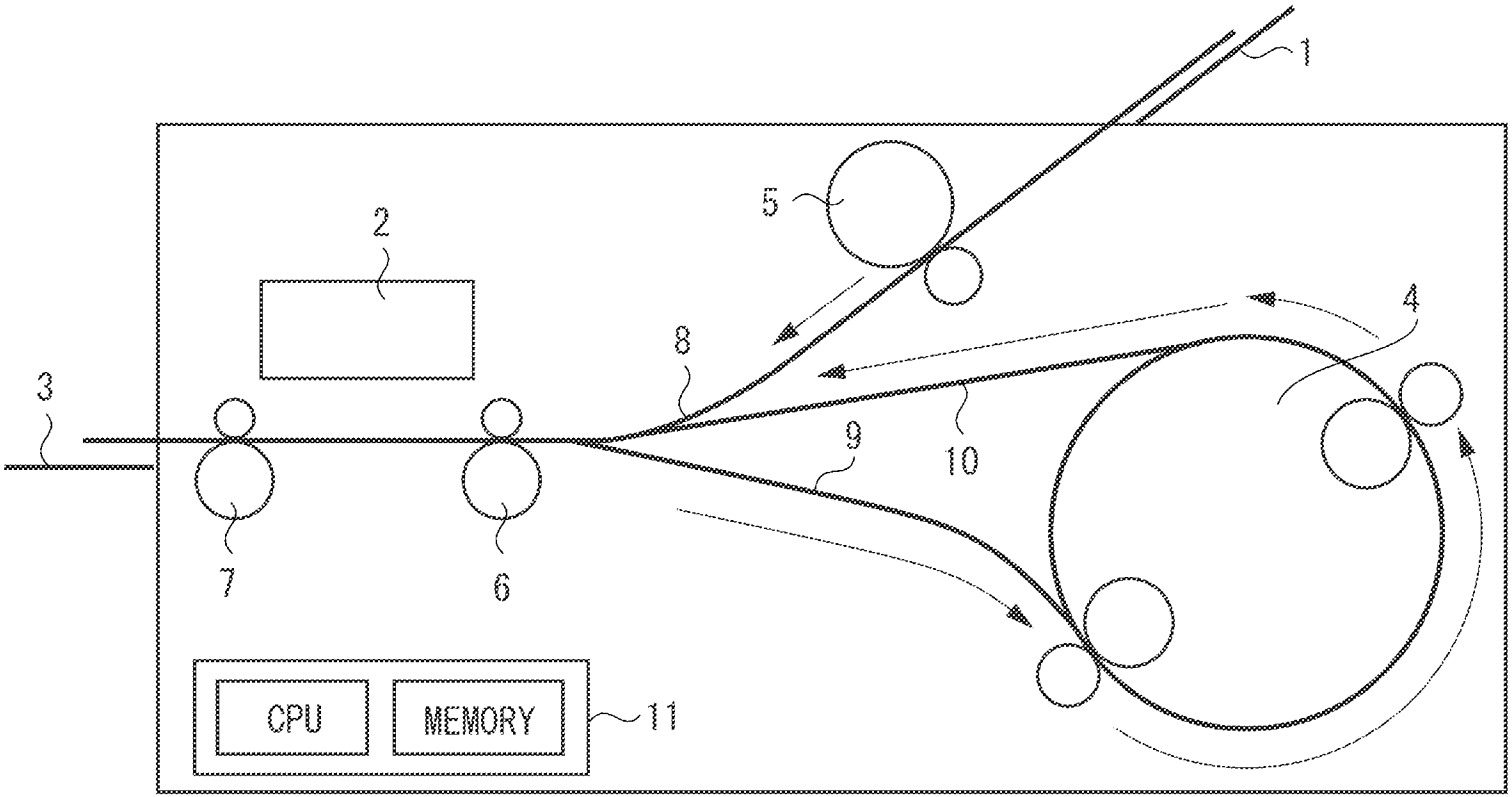
FIG. 1 illustrates a configuration of a printing apparatus.

FIG. 1 schematically illustrates a configuration of a printing apparatus according to an exemplary embodiment of the present invention. This printing apparatus can selectively execute a two-sided printing mode for reversing a sheet therein to print images on both sides (first surface and second surface that is a back surface of the first surface) of the sheet and a one-sided printing mode for printing an image only on the first surface.

The printing apparatus includes a feed unit 1, a printing unit 2, a discharge unit 3, a reversing unit 4 having a plurality of conveyance rollers, a feed roller 5, a conveyance roller 6, and a conveyance roller 7. The conveyance roller 6 is arranged on the upstream side of a conveyance path of the printing unit 2, and the conveyance roller 7 is arranged on the downstream side of a conveying direction of the printing unit 2. As paths for conveying the sheet in the printing apparatus, there are arranged a conveyance path 8 through which the sheet fed from the feed unit 1 passes and reversal conveyance paths 9 and 10 through which the sheet passes when it is reversed. Further, to control various processes of the printing apparatus overall, a control unit 11 that includes a central processing unit (CPU), a memory, and an input/output (I/O) interface is installed. A control unit usable in this case is not limited to the control unit 11 installed in the printing apparatus. A control unit prepared by installing printing control software in an external host device (personal computer (PC)) of the printing apparatus can be used.

The printing unit 2 applies ink to the sheet from a print head using an ink-jet method to execute printing by a serial printing method or a line printing method. The print head includes a nozzle array corresponding to seven colors of cyan (C), magenta (M), yellow (Y), light cyan (LC), light magenta (LM), gray (G), and black (K). For the ink-jet method, a method using a heating element, a method using a piezo element, a method using an electrostatic element, or a method using a microelectromechanical system (MEMS) element can be employed.

In the one-sided printing mode, under control of the control unit 11, the sheet fed from the feed unit 1 by the conveyance roller 5 is conveyed along the conveyance path 8. An image is printed on the first surface of the conveyed sheet by the printing unit 2, and then the sheet is discharged to the discharge unit 3.

In the two-sided printing mode, the sheet fed from the feed unit 1 by the conveyance roller 5 is conveyed along the conveyance path 8. An image is printed on the first surface of the fed sheet by the printing unit 2. The operation is similar to that of the one-sided printing mode thus far. After completion of printing on the first surface at the printing unit 2, without completely discharging the printed sheet to the discharge unit 3, the conveyance of the sheet is temporarily stopped in a state where a trailing edge of the sheet is nipped in the conveyance roller 7. Then, the conveyance roller 6 and the conveyance roller 7 are reversely rotated to convey the sheet in a reverse direction, and convey the sheet to the conveyance path 9 heading for the reversing unit 4. At the reversing unit 4, the sheet is conveyed in a circular arc shape, and the sheet that has reached the conveyance path 10 is reversed for back and front surfaces. The sheet reversed for front and back surfaces at the reversing unit 4 is fed again to the printing unit 2, and printing is executed on the second surface of the sheet. The sheet printed on the both sides is discharged to the discharge unit 3 by the conveyance roller 7. In this case, the sheet reversed for back and front surfaces at the reversing unit 4 is also reversed for trailing and leading sides. The trailing and leading sides of the sheet mean trailing and leading sides in the sheet conveying direction: a leading edge of the sheet advancing during printing on the first surface is the leading side, and a trailing edge is the trailing side. The image is sequentially recorded from front to back on the first surface of the sheet, and conversely the image is sequentially recorded from back to forth on the second surface.

The reversing unit 4 has a path formed with a length to contain at least one sheet. When printing is executed on the second surface following the first surface, the sheet is temporarily set on standby at the reversing unit 4 until the ink applied to the first surface sufficiently dries. When printing is executed on the second surface without waiting until drying, the sheet where cockling or curling has occurred due to wetting by the ink is fed to the printing unit 2. Then, a possibility that the partially floating sheet comes into contact with the print head and conveyance jamming occurs is increasing.

The waiting time during which the sheet is temporarily set on standby at the reversing unit 4 for drying is mainly determined by an ink application amount to the last printed trailing edge area of the first surface of the sheet. This is because the last printed area of the first surface is first printed on the second surface. A method for determining the waiting time for a temporarily standby state will be described below.

Figure 2:
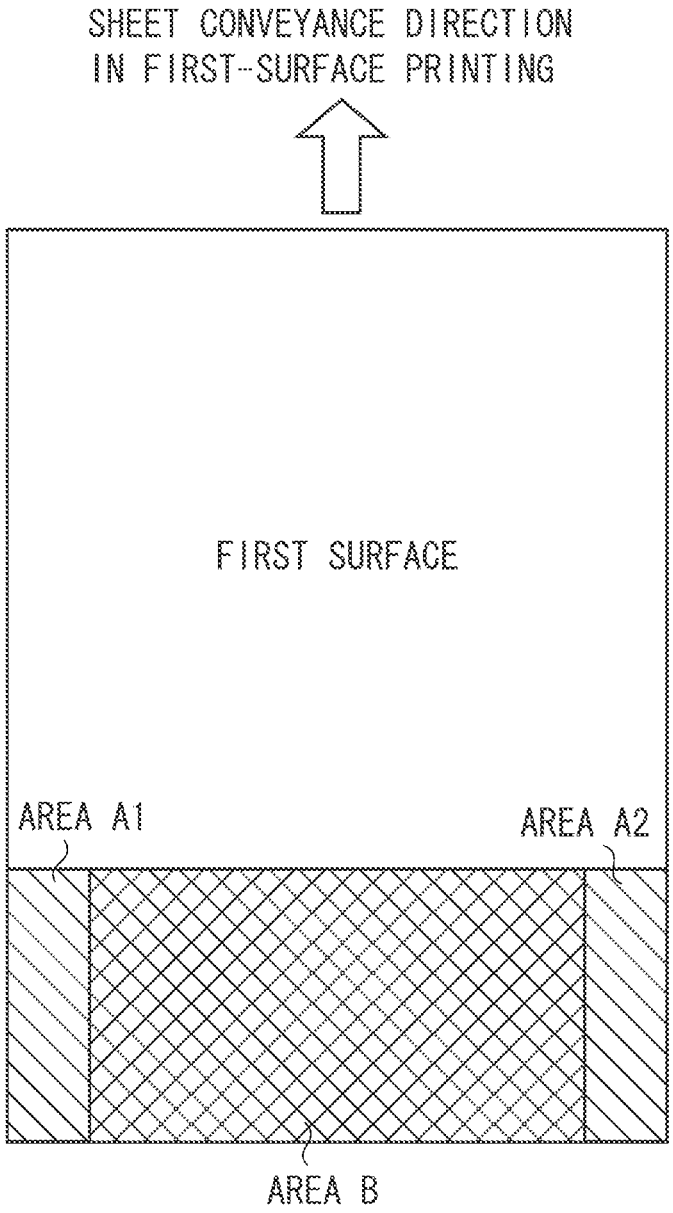
FIG. 2 illustrates a state where virtual divided areas have been set on a first surface of a sheet.

To determine the waiting time, attention is focused on an ink application amount to the edge area of the sheet during printing on the first surface. FIG. 2 illustrates a state where virtual divided areas are set on the first surface of the sheet. An area to evaluate the ink application amount is set in the sheet trailing edge area in a conveying direction during the first surface printing. The area is divided into three areas A1, A2, and B. The area A1 is a left edge in a sheet width direction, and the area A2 is a right edge in the sheet width direction. The area B is a center area sandwiched between the area A1 and the area A2.

It is supposed that a size of the sheet to use is an A4 size (297 mm×210 mm) based on Japanese Industrial Standards (JIS) or a letter size (11 inches×8.5 inches, i.e., U.S. letter size). Each of the area A1 and the area A2 can have widths of about 10% (about 20 millimeters) of the total sheet width in the sheet width direction. The area B accordingly has a width of about 80% (about 160 millimeters) of the total. The sizes of the area A1 and the area A2, which are not limited to 10%, can be set within a range of 5% to 40%. In the sheet conveying direction, lengths of the area A1, the area A2, and the area B can be about 25% (about 80 millimeters) of the total sheet length from the sheet trailing edge. Not limited to 25%, however, the lengths can be set within a range of 10% to 80%. When the sheet to use has a size different from the A4 size or the letter size, the above-described numerical values of % and mm can be changed.

Thus, the sheet trailing edge area of the first surface is divided into the area A1 and the area A2 of a predetermined range from both edges in the sheet width direction, and the area B including an area sandwiched between the area A1 and the area A2. Hereinafter, the area A1 and the area A2 are collectively referred to as "area A". As described below, greater weight is added to the area A1 and the area A2 than that to the area B to determine waiting time T.

Figure 5:
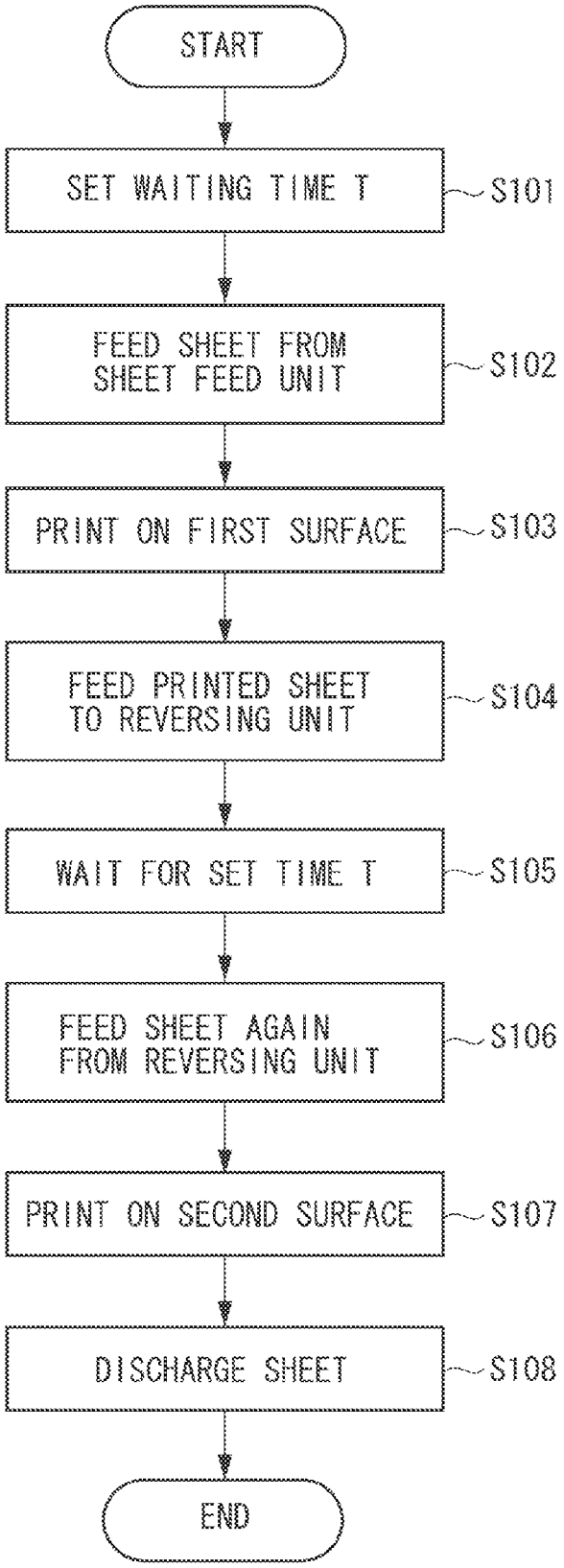
FIG. 5 is a flowchart illustrating an overall processing procedure in a two-sided printing mode.

FIG. 5 is a flowchart illustrating an overall processing procedure in the two-sided printing mode. The processing is carried out under printing control of the control unit 11.

In step S101, waiting time T until a printing start on the second surface from the end of printing in the sheet trailing edge area of the first surface is determined. The waiting time T is time necessary for drying ink applied to the sheet trailing edge area of the first surface. A determination method is described in detail below.

In step S102, one sheet is fed from the feed unit 1. In step S103, an image is printed on a first surface of the fed sheet by the printing unit 2. In step S104, the printed sheet is returned to be fed to the reversing unit 4.

In step S105, the sheet is held at the reversing unit 4, and the processing stands by for the waiting time T set in step S101. Then, in step S106, the sheet is fed again from the reversing unit 4 to the printing unit 2. As described above, the sheet fed again to the printing unit 2 has been reversed for back and front surfaces and for trailing and leading sides.

In step S107, an image is printed on a second surface of the fed sheet. The fed sheet has no cockling or curling because it has been dried during the waiting time in step S105, and hence stable sheet conveyance and printing are carried out. In step S108, the sheet, on the second surface of which the image has been printed, is discharged to the discharge unit 3. This completes the two-sided printing sequence.

Figure 6:
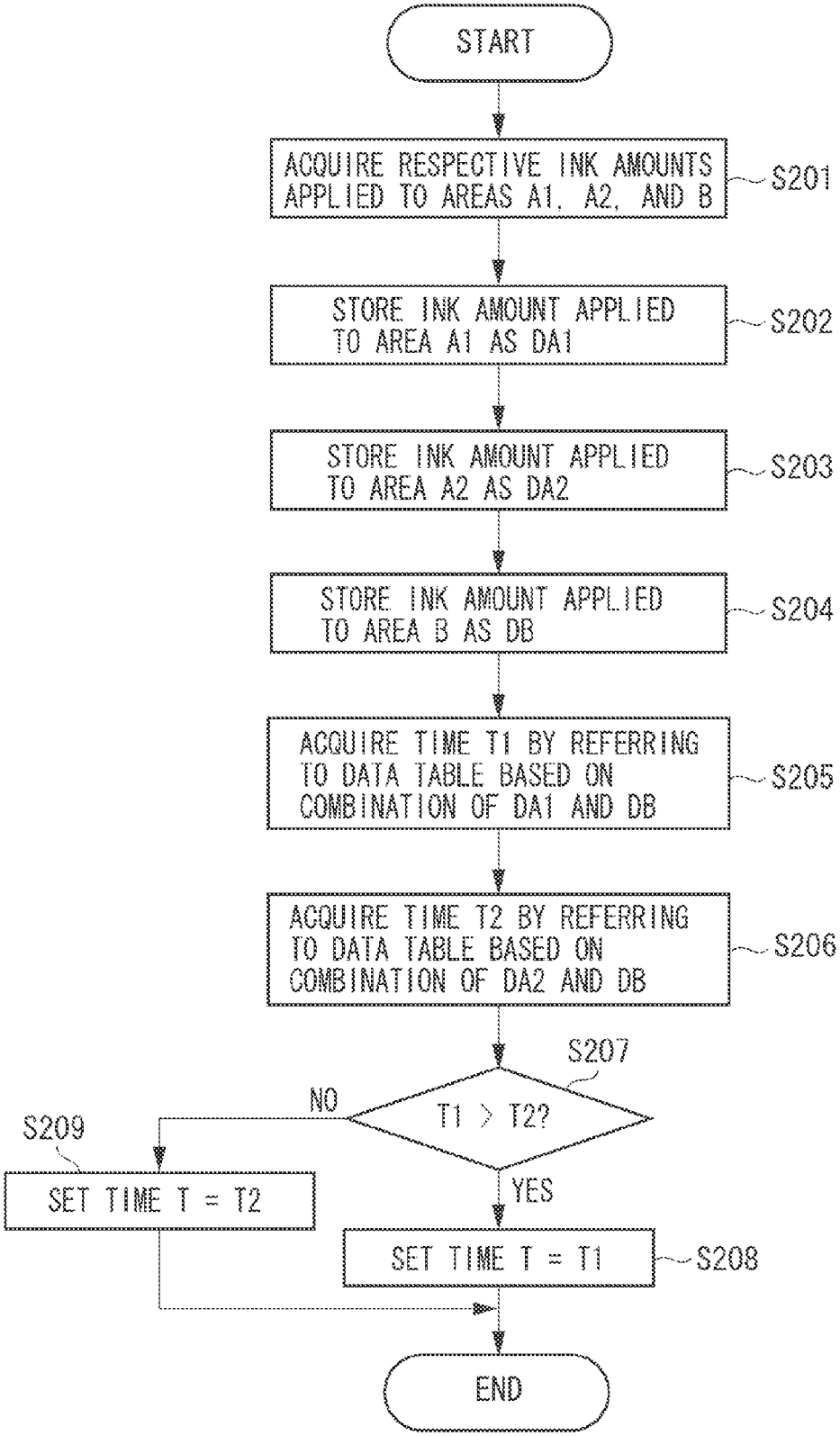
FIG. 6 is a flowchart illustrating a specific processing procedure for setting waiting time T.

FIG. 6 is a flowchart illustrating a specific processing procedure of setting the waiting time T in the routine of step S101 illustrated in FIG. 5.

In step S201, information regarding respective ink application amounts to the area A1, the area A2, and the area B illustrated in FIG. 2 is acquired. The information regarding the ink amount applied to each area can be acquired by calculating information regarding a recording duty of each area through analysis of image data to be recorded. A specific calculation method is described in detail below.

In step S202, the acquired information of the ink application amount to the area A1 is stored as DA1 in the memory of the control unit 11. In step S203, the acquired information of the ink application amount to the area A2 is similarly stored as DA2 in the memory of the control unit 11. In step S204, the acquired information of the ink application amount to the area B is similarly stored as DB in the memory of the control unit 11.

In step S205, based on a combination of the stored DA1 and DB, waiting time T1 is acquired by referring to a data table stored in the memory. In step S206, based on a combination of the stored DA2 and DB, waiting time T2 is acquired by referring to the data table stored in the memory.

In step S207, values of acquired T1 and T2 are compared with each other. When T1>T2 is determined (YES in step S207), the processing proceeds to step S208. When not T1>T2 (NO in step S207), the processing proceeds to step S209. In step S208, waiting time T=T1 is set. In step S209, waiting time T=T2 is set. Then, the processing routine is ended, and the processing returns to step S102 illustrated in FIG. 5.

Thus, the waiting time for each of the area A1 and the A2 with respect to the area B is temporally acquired, and the longer time is employed as final waiting time T.

Figure 7:
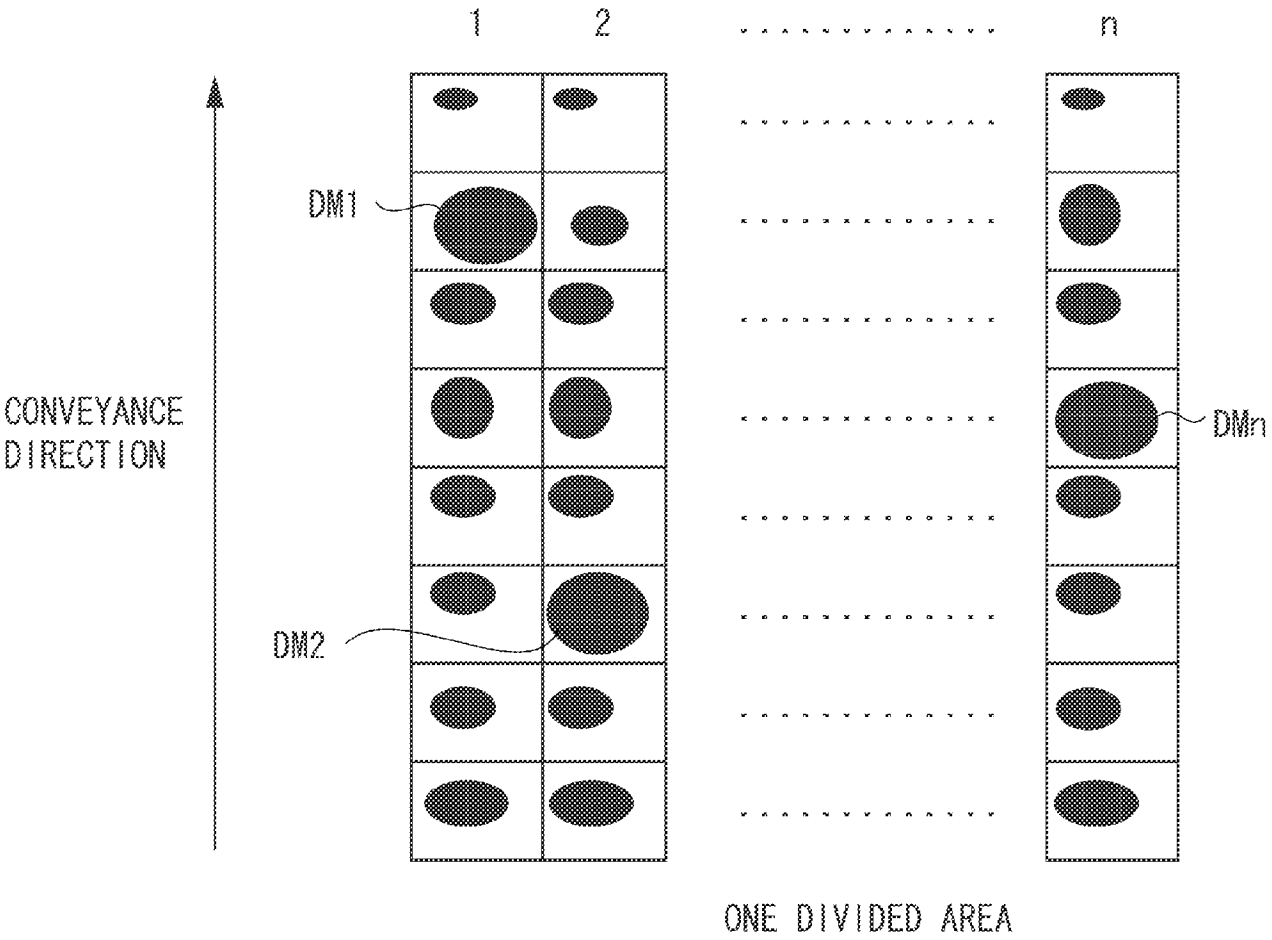
FIG. 7 illustrates a method for calculating an ink application amount to a certain divided area.

The method for calculating the ink application amount in step S201 is described. FIG. 7 illustrates a method for calculating an ink application amount to a certain divided area. As illustrated, one divided area is divided into grids of predetermined unit sizes. In this example, in a conveying direction, there are n arrays of sets of unit grids in one area. Arrays can be set in a sheet width direction.

An ink amount (recording duty) applied to each of the unit grids is calculated based on image data of an image to be printed. A maximum value of ink amounts (number of dots) applied to the unit grids of each array is calculated to be stored for each grid array. A unit grid of a first array is set as DM1, and a unit grid of an n-th array is set as DMn. The maximum application amounts are averaged in the area, and the average is employed as an ink application amount of the area. An ink application amount D of a certain area is represented by the following calculation formula. By using this calculation formula, information regarding an ink application amount of each area is acquired.

$$D = \sum_{i=1}^{n} \frac{DMi}{n} \qquad \text{Equation 1}$$

Next, a specific method in steps S205 and S206 illustrated in FIG. 6 will be described. Table 1 is a correspondence table for dividing ink application amounts DA (DA1 or DA2) to the area A1 or A2 into a plurality of ranges to acquire a corresponding identification (ID) (Table_ID).

TABLE 1

| Ink application amount (DA) | ID |
|---|---|
| 0 ≤ DA < da1 | ID_1 |
| da1 ≤ DA < da2 | ID_2 |
| da2 ≤ DA < da3 | ID_3 |
| da3 ≤ DA | ID_4 |

In this example, the ink application amounts are divided into four ranges of 0≤DA<da1, da1≤DA<da2, da2≤DA<da3, and da3≤DA, and the ranges are respectively represented by ID_1, ID_2, ID_3, and ID_4. Specifically, by referring to the correspondence Table 1, one of the four IDs is added to the ink application amount DA1 according to its value, and one of the four IDs is similarly added to the ink application amount DA2 according to its value.

Table 2 is a two-dimensional data table for acquiring optimal waiting time according to a combination of respective ink application amounts to the area A (area A1 or area A2) and the area B.

TABLE 2

| Waiting time T | | | | |
|---|---|---|---|---|
| Ink application | ID of ink application amount (DA) | | | |
| amount (DB) | ID_1 | ID_2 | ID_3 | ID_4 |
| 0 ≤ DB < db1 | t11 | t21 | t31 | t41 |
| db1 ≤ DB < db2 | t12 | t22 | t32 | t42 |
| db2 ≤ DB < db3 | t13 | t23 | t33 | t43 |
| db3 ≤ DB | t14 | t24 | t34 | t44 |

In this example, a vertical axis of the two-dimensional table indicates ink application amounts to the area B, which are divided into four ranges of 0≤DB<db1, db1≤DB<db2, db2≤DB<db3, and db3≤DB. A horizontal axis of the two-dimensional table indicates 101, ID_2, ID_3, and ID_4 added in the Table 1. For combinations of 4×4=16, respective individual waiting time periods (t11 to t44) are stored in the memory of the control unit 11.

In step S205 illustrated in FIG. 6, time T1 is acquired by referring to the data table concerning which data in the two-dimensional table a combination of values of the ink application amount DA1 and the ink application amount DB corresponds to. In step S206, time T2 is acquired by referring to the data table concerning which data in the two-dimensional table a combination of values of the ink application amount DA2 and the ink application amount DB corresponds to.

The respective waiting time periods t11 to t44 of the Table 2 are determined by adding greater weight to the area A1 and the area A2 than that to the area B. It is because curling or cockling occurs more easily at the edges than at the center (area B) of the sheet. The waiting time t14 of the highest value range of the DB in the ID_1 that is a lowest range of the ink application amount to the area A has a value smaller than that of the waiting time t41 that is a lowest value range of the DB in the ID_4 that is a highest range of the ink application amount to the area A (t41<t14). Needless to say, as a total ink application amount of the area A and the area B is larger, waiting time T is longer.

Based on such an idea of weighting, values of the waiting time periods t11 to t44 are determined. Table 3 illustrates an example. Maximum values of the DA and the DB are maximum values of recording duties, which can take the value of 100 or higher. Threshold values of ranges are da1=15, da2=30, da3=45, db1=15, db2=30, and db3=45.

TABLE 3

| Waiting time T (second) | | | | |
|---|---|---|---|---|
| Ink application | ID of ink application amount (DA) | | | |
| amount (DB) | ID_1 | ID_2 | ID_3 | ID 4 |
| 0 ≤ DB < 15 | 0 sec | 0 sec | 5 sec | 10 sec |
| 15 ≤ DB < 30 | 0 sec | 0 sec | 5 sec | 10 sec |
| 30 ≤ DB < 45 | 0 sec | 5 sec | 10 sec | 15 sec |
| 45 ≤ DB | 0 sec | 5 sec | 10 sec | 15 sec |

Figure 3:
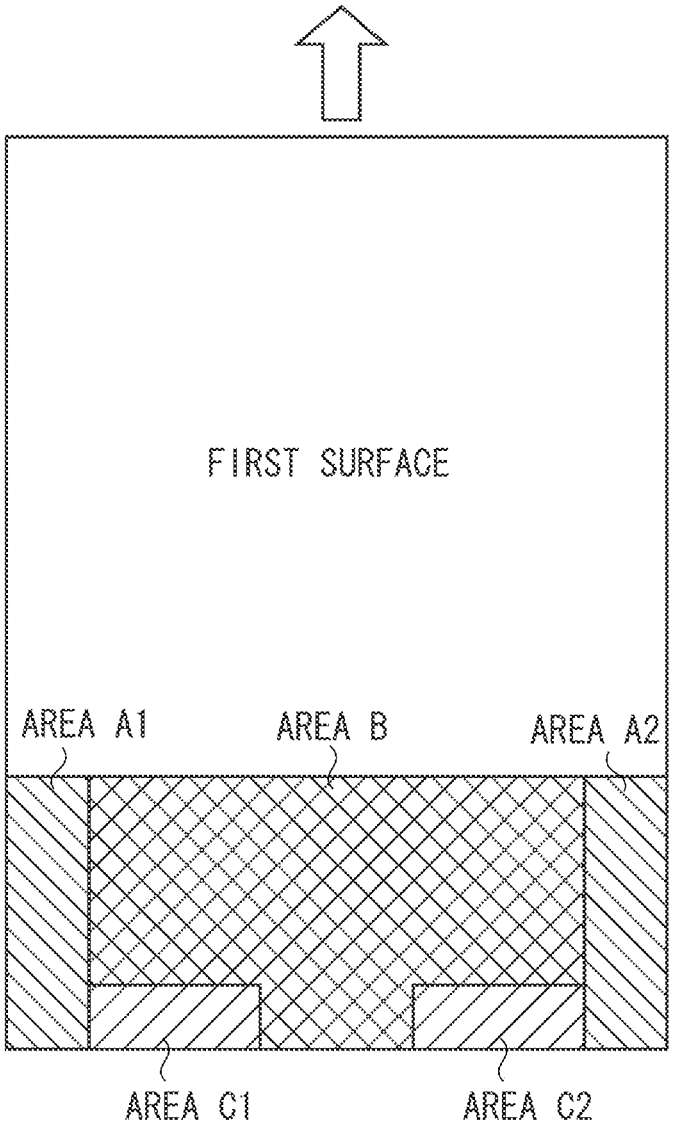
FIG. 3 illustrates a modified example of the state illustrated in FIG. 2.

FIG. 3 illustrates another example of area division. This example takes into consideration floating of not only the right and left edges of the sheet but also the sheet trailing edge. The sheet trailing edge of the first surface is divided into an area A1 and an area A2 of predetermined ranges from both edges in the sheet width direction, an area B including an area sandwiched between the area A1 and the area A2, and an area C of a predetermined range from the sheet trailing edge in the sheet conveying direction. The area C includes an area C1 and an area C2 separated from each other in the sheet width direction. Alternatively, without being divided into two areas, namely, an area C1 and an area C2, a unit area C including these areas can be arranged between the area A1 and the area A2.

Supposing a sheet of an A4 size or a letter size, sizes of the area A1, the area A2, and the area B are similar to those illustrated in FIG. 2. The area C (C1 and C2) can be set to about 5% (about 15 millimeters) of a total sheet length from the sheet trailing edge in the sheet conveying direction. Not limited to 5%, however, the length can be set within a range of 3% to 15%. In the sheet width direction, the area C1 can be set to about 25% (about 50 millimeters) with respect to a sheet horizontal width in contact with the area A1, and the area C2 can be set to about 25% (about 50 millimeters) with respect to a sheet horizontal width in contact with the area A2. When a sheet to use has a size different from the A4 size or the letter size, the above-described numerical values of % and mm can be changed.

A method for calculating waiting time based on a relationship between the areas A1 and A2 and the area B is as described above. By a similar method, waiting time is calculated for a relationship between the areas C1 and C2 and the area B. A two-dimensional data table similar to that illustrated in the Table 1 is prepared. Ink application amounts to the area C1 and to the area B, and ink application amounts to the area C2 and to the area B are respectively acquired, and appropriate waiting time periods T are determined by referring to the data table. The longest time among the waiting time periods thus acquired is determined as final waiting time T.

Greater weight is added to the area A (area A1 and area A2) than that to the area B to determine waiting time. Greater weight is added to the area C (area C1 and area C2) than that to the area B to determine waiting time. The weight added to the area A is greater than that added to the area C. Alternatively, equal weight can be added to the area A and the area C.

In the examples illustrated in FIGS. 2 and 3, the area A has a higher possibility of jamming or head rubbing than the other areas. Thus, when the ink application amounts DA1 and DA2 to the area A are both equal to or less than a predetermined threshold value (ID=ID_1 in the Table 1), a determination algorithm to determine waiting time T to a minimum value (e.g., zero) irrespective of values of ink application amounts to the other areas can be employed. In the example illustrated in the Table 3, based on such an algorithm, t11=t12=t13=t14=0 is set.

Figure 4:
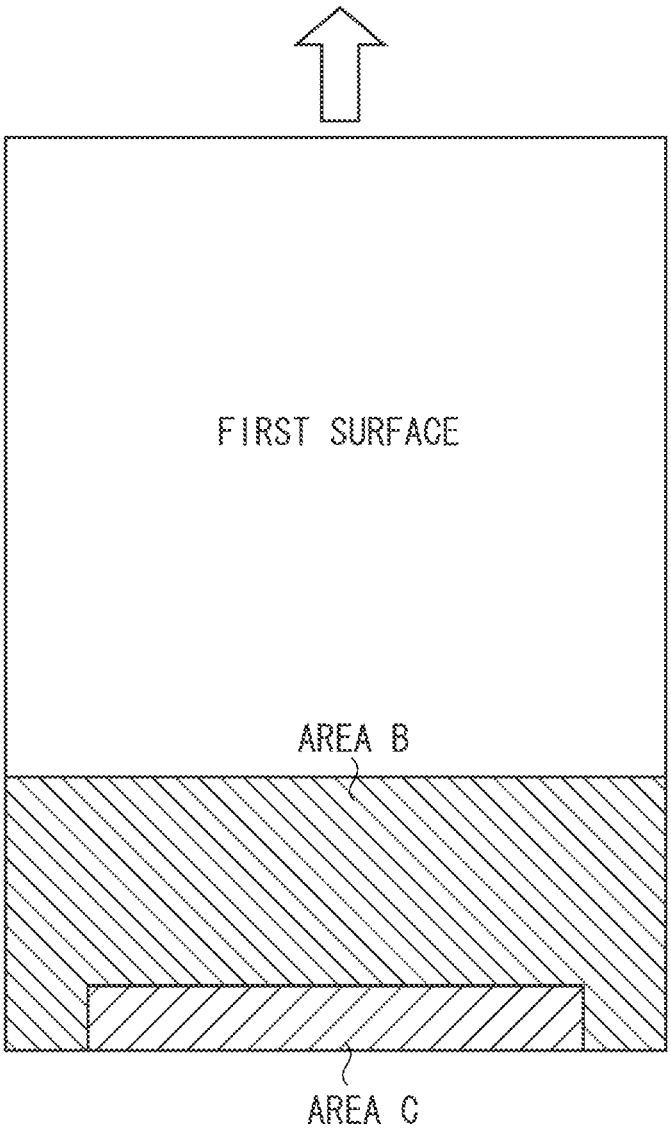
FIG. 4 illustrates another modified example of the state illustrated in FIG. 2.

FIG. 4 illustrates yet another example of area division. This example is effective for an apparatus configuration that includes a guide member to suppress floating of the sheet right and left edges in the conveyance path. Since the floating of the sheet right and left edges is suppressed by the guide member, attention is focused on floating of the sheet trailing edge.

The sheet trailing edge of the first surface is divided into an area C of a predetermined range from the sheet trailing edge in the sheet conveying direction, an area B including the area C and away from the sheet trailing edge more than the area C. Supposing a sheet of an A4 size or a letter size, the area C can be set to about 5% (about 15 millimeters) of a total sheet length from the sheet trailing edge in the sheet conveying direction. Not limited to 5%, however, the length can be set within a range of 3% to 15%. In the sheet width direction, the area C can be set inside more than 5% (about 10 millimeters) of a horizontal width of the sheet from both of the right and left edges of the sheet. A length of the area C can be set to about 25% (about 80 millimeters) of the total sheet length from the sheet trailing edge. Not to limited to 25%, however, the length can be set within a range of 10% to 80%. When a sheet to use has a size different from the A4 size or the letter size, the above-described numerical values of % and mm can be changed.

In the divided areas, greater weight is added to the area C than that to the area B to determine waiting time. A two-dimensional data table similar to that illustrated in the Table 2 is prepared. Ink application amounts to the area C and to the area B are respectively acquired, and appropriate waiting time periods T are determined from these values by referring to the data table.

According to the exemplary embodiment, for each of the plurality of areas different from one another in at least one of the sheet width direction and the sheet conveying direction, which are included in the sheet trailing edge area during the printing on the first surface, the information regarding the ink application amount to the area is acquired. Then, according to the combination of the acquired pieces of information regarding the ink application amounts to each of the plurality of areas, the waiting time until the printing start on the second surface from the edge of the printing in the sheet trailing edge area is determined.

Japanese Patent No. 4522156 discusses the conventional method in which without adding any weight, waiting time is acquired for each of the plurality of areas, and longest waiting time is selected to be set. This creates a possibility that time longer than necessary will be set even for the pattern of a low jamming possibility. On the other hand, according to this embodiment, the waiting time is comprehensively determined according to the combination of the pieces of information regarding the ink application amounts to the plurality of areas and by adding weight. As a result, while suppressing jamming or head rubbing, the waiting time before the printing on the second surface can be shortened more than the conventional technique. In other words, improvement of printing throughput can be expected.

According to the exemplary embodiment, the two-dimensional data table similar to the Table 2 is prepared beforehand, and the waiting time T is acquired by referring to the data table. However, the present invention is not limited to this. For example, when there are three or more areas, in other words, three or more variable, three or more multidimensional data tables can be prepared, and final waiting time T can be determined by referring to the data tables. Furthermore, without using any data table, variables can be input to a predetermined calculation formula for calculating waiting time to execute calculation, thereby determining waiting time T.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-118269 filed May 26, 2011, which is hereby incorporated by reference herein in its entirety.

What is claimed is:

1. A printing control method for performing control of printing so as to feed a sheet to a printing unit, print an image on a first surface of the sheet, reverse the sheet for (i) a first surface and a second surface which is a back surface to the first surface of the sheet and (ii) a leading side of the sheet in a feed direction and a trailing side of the sheet in the feed direction, and print an image on the second surface in sequence, the printing control method comprising steps of:

acquiring information regarding ink application amounts to each of a plurality of different areas on a sheet trailing edge of the first surface, including at least a first area which covers a center portion of the sheet in a width direction crossing to the feed direction and a second area which covers one edge of the sheet in the width direction;

assessing a plurality of candidate times including a time T1 which is assessed in accordance with a weighted combination of the ink application amount to the first area indicated by the information acquired by the acquiring step and the ink application amount to the second area indicated by the information acquired by the acquiring step; and determining a waiting time, for the control of the printing, until a start of printing on the second surface from an end of printing on the sheet trailing edge on the first surface based on the plurality of candidate times.

2. The printing control method according to claim 1, further comprising the step of:

storing a data table in which different times are determined according to a combination of the information regarding the ink application amount to the first area and the information regarding the ink application amount to the second area, wherein the assessing step is performed to assess the time T1 by referring to the data table.

3. The printing control method according to claim 1, wherein the plurality of different areas further includes a third area which covers the other edge of the sheet in the width direction, and wherein the assessing step is further performed to assess a time T2, included in the plurality of candidate times, in accordance with a combination of the ink application amount to the first area indicated by the information acquired by the acquiring step and the ink application amount to the third area indicated by the information acquired by the acquiring step.

4. The printing control method according to claim 3, wherein the assessing step is performed to assess the time T1 by adding greater weight to the second area than that to the first area, and assess the time T2 by adding greater weight to the third area than that to the first area.

5. The printing control method according to claim 3, wherein the assessing step is performed to assess the time T1 to be minimum irrespective of the ink application amount to the first area, when the ink application amount to the second area is equal to or less than a predetermined threshold value.

6. The printing control method according to claim 5, wherein the assessing step is performed to assess the time T1 to be minimum in a case where the ink application amount to the first area is respectively large when the ink application amount to the second area is equal to or less than a predetermined threshold value.

7. The printing control method according to claim 3, wherein the determining step is performed to determine which one is larger in value among the time T1 and the time T2 as the waiting time.

8. The printing control method according to claim 7, wherein the second area and the third area comprise, in a sheet of an A4 size or a letter size, sizes within a range of 5% to 40% of a total sheet width in the sheet width direction, and sizes within a range of 10% to 80% of a total sheet length from the sheet trailing edge in the feed direction.

9. The printing control method according to claim 1, wherein the plurality of different areas further includes a third area which covers the other edge of the sheet in the width direction, and a fourth area which has a predetermined range and is positioned at the sheet trailing edge in the feed direction, wherein the first area extends away from the sheet trailing edge more than the fourth area in the feed direction, and wherein the assessing step is further performed to assess a time T2, included in the plurality of candidate times, in accordance with a combination of the ink application amount to the first area indicated by the information acquired by the acquiring step and the ink application amount to the third area indicated by the information acquired by the acquiring step, and assess a time T3, included in the plurality of candidate times in accordance with a combination of the ink application amount to the first area indicated by the information acquired by the acquiring step and the ink application amount to the fourth area indicated by the information acquired by the acquiring step.

10. The printing control method according to claim 9, wherein the fourth area is divided into two of fourth areas in the width direction.

11. The printing control method according to claim 9, wherein the second area and the third area comprise, in a sheet of an A4 size or a letter size, sizes within a range of 5% to 40% of a total sheet width in the feed direction, and sizes within a range of 10% to 80% of a total sheet length from the sheet trailing edge in the feed direction, and the fourth area has a size within a range of 3% to 15% of a total sheet length from the sheet trailing edge in the feed direction.

12. The printing control method according to claim 9, wherein the assessing step is performed to assess the time T1 by adding greater weight to the second area than that to the first area, assess the time T2 by adding greater weight to the third area than that to the first area, and assess the time T3 by adding greater weight to the fourth area than that to the first area.

13. The printing control method according to claim 9, wherein the determining step is performed to determine which one is the largest in value among the time T1, the time T2 and the time T3 as the waiting time.

14. The printing control method according to claim 1, wherein the acquiring step is performed to acquire an ink application amount to the area by dividing each of the plurality of different areas into grids and calculating an ink amount applied to each divided grid from image data.

15. The printing control method according to claim 14, wherein the acquiring step is performed to acquire the ink application amount to each of the plurality of different areas by acquiring maximum values of ink amounts applied to the plurality of grids for each grid to calculate an average maximum value.

16. The printing control method according to claim 1, wherein the waiting time includes a time during which the sheet is waiting at a reversing unit which performs reversing of the sheet.

17. The printing control method according to claim 1, wherein the assessing step is configured to assess the time T1 such that the time T1 in a case that the ink application amount to the first area indicated by the information acquired by the acquiring step is a first amount and the ink application amount to the second area indicated by the information acquired by the acquiring step is a second amount, is lower than the time T1 in a case that the ink application amount to the first area indicated by the information acquired by the acquiring step is a first amount and the ink application amount to the second area indicated by the information acquired by the acquiring step is a third amount which is larger than the second amount.

18. A printing control method for performing control of printing so as to feed a sheet to a printing unit, print an image on a first surface of the sheet, reverse the sheet for (i) a first surface and a second surface which is a back surface to the first surface of the sheet and (ii) a leading side of the sheet in a feed direction and a trailing side of the sheet in the feed direction, and print an image on the second surface in sequence, the printing control method comprising steps of:

acquiring information regarding ink application amounts to each of a plurality of different areas on a sheet trailing edge of the first surface, including at least a first area and a second area, wherein the first area extends away from the sheet trailing edge more than the second area in the feed direction;

assessing a time T1 in accordance with a weighted combination of the ink application amount to the first area indicated by the information acquired by the acquiring step and the ink application amount to the second area indicated by the information acquired by the acquiring step; and determining a waiting time until a start of printing on the second surface from an end of printing on the sheet trailing edge on the first surface based on the time T1.

19. The printing control method according to claim 18, wherein the second area comprises, in a sheet of an A4 size or a letter size, a size within a range of 3% to 15% of a total sheet length from the sheet trailing edge in the feed direction, and the first area has a size within a range of 10% to 80% of a total sheet length.

20. The printing control method according to claim 18, wherein the assessing step is performed to assess the time T1 by adding greater weight to the second area than that to the first area.

21. A printing apparatus comprising:

a printing unit;

a control unit configured to control to feed a sheet to the printing unit, to cause the printing unit to print an image on a first surface of the sheet, to reverse the sheet for (i) a first surface and a second surface which is a back surface to the first surface of the sheet and (ii) a leading side of the sheet in a feed direction and a trailing side of the sheet in the feed direction, and to print an image on the second surface in sequence;

an acquiring unit configured to acquire information regarding ink application amounts to each of a plurality of different areas on a sheet trailing edge of the first surface, including at least a first area which covers a center portion of the sheet in a width direction crossing to the feed direction and a second area which covers one edge of the sheet in the width direction;

an assessing unit configured to assess a plurality of candidate times including a time T1 in accordance with a weighted combination of the ink application amount to the first area indicated by the information acquired by the acquiring unit and the ink application amount to the second area indicated by the information acquired by the acquiring unit; and a determining unit configured to determine a waiting time, used for the control unit, until a start of printing on the second surface from an end of printing on the sheet trailing edge on the first surface based on the plurality of candidate times.

22. The printing apparatus according to claim 21, wherein the plurality of different areas further includes a third area which covers the other edge of the sheet in the width direction, and wherein the assessing unit further assesses a time T2, included in the plurality of candidate times, in accordance with a combination of the ink application amount to the first area indicated by the information acquired by the acquiring unit and the ink application amount to the third area indicated by the information acquired by the acquiring unit.

23. The printing apparatus according to claim 22, wherein the determining unit determines which one is larger in value among the time T1 and the time T2 as the waiting time.

24. The printing apparatus according to claim 21, wherein the plurality of different areas further includes a third area which covers the other edge of the sheet in the width direction, and a fourth area which has a predetermined range and is positioned at the sheet trailing edge in the feed direction, wherein the first area extends away from the sheet trailing edge more than the fourth area in the feed direction, and wherein the assessing unit further assesses a time T2, included in the plurality of candidate times, in accordance with a combination of the ink application amount to the first area indicated by the information acquired by the acquiring unit and the ink application amount to the third area indicated by the information acquired by the acquiring unit, and assesses a time T3, included in the plurality of candidate times, in accordance with a combination of the ink application amount to the first area indicated by the information acquired by the acquiring unit and the ink application amount to the fourth area indicated by the information acquired by the acquiring unit.

25. The printing apparatus according to claim 24, wherein the determining unit determines which one is the largest in value among the time T1, the time T2, and the time T3 as the waiting time.

26. A printing apparatus comprising:

a printing unit for applying ink to a sheet;

a controlling unit configured to control printing operation to the sheet by the printing unit, so as to cause the printing unit to print an image on a first surface of the sheet, to reverse the sheet for the first surface and a second surface which is a back surface to the first surface of the sheet and reverse the sheet for a leading side of the sheet in a feed direction and a trailing side of the sheet in the feed direction, and to cause the printing unit to print an image on the second surface in sequence;

an acquiring unit configured to acquire information regarding ink application amounts to each of a plurality of different areas on a sheet trailing end of the first surface, including at least a first area positioned between one end portion of the sheet in a width direction crossing to the feed direction and another end portion of the sheet in the width direction and a second area corresponding to the one end portion of the sheet;

an assessing unit configured to assess a time T1 in accordance with a weighted combination of the ink application amount to the first area indicated by the information acquired by the acquiring unit and the ink application amount to the second area indicated by the information acquired by the acquiring unit; and a determining unit configured to determine a waiting time, used for the controlling unit, for waiting to start of printing on the second surface, the waiting time being included in a time between an end of printing on the sheet trailing end on the first surface and the start of printing on the second surface, based on the time T1 assessed by the assessing unit.

27. The printing apparatus according to claim 26, wherein the plurality of different areas further includes a third area corresponding to the other end portion of the sheet, wherein the assessing unit further assesses a time T2 in accordance with a combination of the ink application amount to the first area indicated by the information acquired by the acquiring unit and the ink application amount to the third area indicated by the information acquired by the acquiring unit, and wherein the determining unit determines the waiting time based on the time T1 and the time T2 assessed by the assessing unit.

28. The printing apparatus according to claim 27, wherein the determining unit determines which one is larger in value among the time T1 and the time T2 as the waiting time.

29. The printing apparatus according to claim 27, wherein the assessing unit assesses the time T1 by adding greater weight to the second area than that to the first area, and assesses the time T2 by adding greater weight to the third area than that to the first area.

30. The printing apparatus according to claim 26, wherein the plurality of different areas further includes a third area corresponding to the other end portion of the sheet, and a fourth area which has a predetermined range and is positioned at the sheet trailing end in the feed direction, wherein the first area extends away from the sheet trailing end more than the fourth area in the feed direction, wherein the assessing unit further assesses a time T2 in accordance with a combination of the ink application amount to the first area indicated by the information acquired by the acquiring unit and the ink application amount to the third area indicated by the information acquired by the acquiring unit, and assesses a time T3 in accordance with a combination of the ink application amount to the first area indicated by the information acquired by the acquiring unit and the ink application amount to the fourth area indicated by the information acquired by the acquiring unit, and wherein the determining unit determines the waiting time based on the time T1, the time T2, and the time T3 assessed by the assessing unit.

31. The printing apparatus according to claim 30, wherein the determining unit determines which one is the largest in value among the time T1, the time T2, and the time T3 as the waiting time.

32. The printing apparatus according to claim 26, wherein the assessing unit assesses the time T1 by referring to a data table in which different times are determined according to a combination of the information regarding the ink application amount to the first area and the information regarding the ink application amount to the second area.

33. The printing apparatus according to claim 26, wherein the assessing unit assesses the time T1 such that the time T1 in a case that the ink application amount to the first area indicated by the information acquired by the acquiring unit is a first amount and the ink application amount to the second area indicated by the information acquired by the acquiring unit is a second amount is lower than the time T1 in a case that the ink application amount to the first area indicated by the information acquired by the acquiring unit is a first amount and the ink application amount to the second area indicated by the information acquired by the acquiring unit is a third amount which is larger than the second amount.

* * * * *